United States Patent [19]

Sato

[11] 4,036,567

[45] July 19, 1977

[54] GLOBOID WORM TYPE ROTARY MACHINE

[75] Inventor: Goro Sato, Atami, Japan

[73] Assignee: Hokuetsu Kogyo Co., Ltd., Japan

[21] Appl. No.: 566,047

[22] Filed: Apr. 8, 1975

[30] Foreign Application Priority Data

Apr. 15, 1974 Japan ..... 49-40980

[51] Int. Cl.[2] ..... F01C 1/08; F01C 19/00; F04C 17/04; F04C 27/00

[52] U.S. Cl. ..... 418/105; 418/108; 418/195; 74/411; 74/427

[58] Field of Search ..... 418/195, 105, 107–109, 418/156–157, 182; 74/410, 411, 427

[56] References Cited

U.S. PATENT DOCUMENTS

| | | | |
|---|---|---|---|
| 1,106,666 | 8/1914 | Miller | 418/195 |
| 2,158,933 | 5/1939 | Good | 418/195 |
| 2,327,089 | 8/1943 | Bejeuhr | 418/107 |
| 3,788,784 | 1/1974 | Zimmern | 418/195 |

*Primary Examiner*—John J. Vrablik

[57] ABSTRACT

In a globoid worm type compressor or expander comprising a casing, a globoid worm rotor in the casing and pinions meshing with the worm rotor, provision is made to effect sealing between the thread of the worm and each tooth of the pinions. The arrangement is such that the pinion is mounted on its shaft with the intermediary of a resilient member so that each tooth may be slightly displaced in both circumferential and diametric directions whereby to adapt itself to the thread of the worm to provide gas-tight seal between the tooth and the thread of the worm.

6 Claims, 9 Drawing Figures

GLOBOID WORM TYPE ROTARY MACHINE

BACKGROUND OF THE INVENTION

1. Field of the Invention

This invention relates to globoid worm type rotary machines such as compressors, expanders, evacuators or the like.

2. Description of the Prior Art

Globoid worm type compressors, expanders or evacuators are well known which comprise a globoid worm type rotor housed in a casing and pinions cooperating with the rotor to form compression chamber defined by the casing, the worm rotor and the pinions whereby rotation of the worm rotor causes suction, compression and delivery of gas. There are various types of such pinions.

From the nature of the globoid worm type compressor or expander, sealing for the compression or expansion chamber must be provided between the top of the worm rotor and the casing, between the bottom of the worm rotor and the teeth of the pinion, between the both side surface of the pinion teeth and the side surface of the thread of the worm rotor, and between the aperture portion of the casing and the flat surface of the pinion teeth.

While, because the casing is stationary, it is relatively easy to attain accurate contact between the casing and the top of the worm rotor and between the aperture portion of the casing and the flat surface of the pinion teeth in the process of their machining and assembly, the contact between the grooved surface of the worm rotor and the tip of the tooth of the pinion, both being complicatedly curved for sliding engagement when rotated, is difficult to make so accurate as to attain constant sealing. In addition, the teeth of the pinion is arranged at 90° to the worm rotor, it is difficult to assemble the worm rotor and the pinion so that the entire side surface of the pinion tooth will perfectly contact the entire groove of the worm rotor. As a matter of fact, the mechanical efficiency is scattered over a range of between the maximum and minimum amounts of the efficiency.

To cover such error in accuracy, various means have been used, as shown in French Patent No. 1,331,998 or Japanese Patent Application Forced Publication Sho 48-27303, to improve efficiency, such as making the pinion teeth of plastic material, fastening plastic teeth on the shaft of the pinion by means of spring washers to permit them to shift slightly only in the circumferential direction by the torsional elasticity of the spring washers, fixing the pinion on a support therefor by means of pins with elastic members interposed to permit the pinion tooth to shift only in the circumferential direction, notching the root of the pinion tooth to allow its bending to conform to the surface of contact of the worm rotor.

In these prior art means, however, the center hole of the pinion snugly fits the shaft of the pinion or support therefor only for rotation so as to permit a shift only in the circumferential direction with the shaft of the pinion as the fulcrum. Also in the case using notches, the teeth of the pinion are allowed to bend about the notches to shift in the direction of rotation but not allowed to move in diametric direction at all. Moreover, the rotatative shift about a certain point gives different displacement to points near the fulcrum and points far from it and, therefore, when a point near the fulcrum, that is, the root of the tooth, engages the worm rotor, the tip of the tooth gets farther spaced apart from the worm rotor causing leakage of gas there with a resulting decrease in the machine efficiency while the opposite side of the tooth in the circumferential direction is strongly forced against the worm rotor causing a loss of power.

In the case where the tooth is notched at its root to bend thereat, the same result as mentioned above will come out with the notch at the root as fulcrum and, in addition destructive stress will concentrate there causing a large decrease in durability.

The prior art will now be described with reference to the drawings.

FIG. 1 shows, in transverse cross-section, a conventional globoid worm type compressor, wherein the worm rotor 1 is supported by bearings 3 and 4 and driven by power through a shaft 5. As the worm rotor 1 rotates, pinion teeth 2 meshing therewith rotate about shafts 6. The casing 7, together with the worm rotor 1 and the pinion teeth 2, define a compression chamber 8 in it. Gas is drawn through inlet opening 9, introduced into the compression chamber 8, and then sealed by the teeth of the pinion, compressed as the volume of the compression chamber 8 gradually decreases with the rotation of the worm rotor, and discharged through outlet opening 10.

FIG. 2 shows one disclosed in FIG. 7 of French Patent No. 1,331,998, in which, as shown, the pinion teeth 2 of plastic material are tightly fitted together with a metallic support 11 to the shaft 6 of the pinion and is fastened to the shaft 6 by means of its flange 12 and a nut 14 with a spring washer 13 interposed to give more or less torsional elasticity in the circumferential direction. As seen from the figure, a slight shift in only one circumferential direction is permitted but no displacement of the pinion tooth in the diametric direction is permitted because the pinion 2 is snugly mounted on the shaft 6 for the pinion.

FIG. 3 shows FIG. 5 of Japanese Patent Application Forced Publication Sho 48-27303, in which the pinion 2 is mounted on a support 11 by means of a pin 15 secured thereto with a resilient member 16 interposed. Since the pinion teeth 2 is tightly fitted around the outer periphery 18 of the boss 19 of the support 11, the displacement of the tooth, if allowed owing to the elasticity of the resilient member 16, can take place only in one circumferential direction with the center of the periphery 18 of the boss 19 as fulcrum, but not in the diametric direction.

FIG. 4 shows FIG. 9 of Japanese Patent Application Forced Publication Sho 48-27303, in which each tooth of the pinion teeth 2 is notched at its root as at 20 to narrow the width of the tooth root 22 so that it can readily bend there to adapt itself to the thread of the worm rotor 1. Its displacement, also in this case, is permitted only in one circumferential direction with the notched portion 20 as the fulcrum but no displacement is permitted in the diametric direction. In addition the teeth of the pinion will be damaged soon because of the concentration of destructive stress at the notches 20.

It is apparent that in all of the prior art devices mentioned above, displacement in the diametric direction is impossible though displacement in the circumferential direction may be allowed. Therefore, when the tip 21 of the tooth 2 of the pinion strikes the worm rotor, it cannot be relieved and causes loss of power. What is more undesirable is that the displacement in the circumferential direction takes place with the periphery 18 of boss 19 as the fulcrum or with the notched portion 20 as the fulcrum and therefore, when the root portion (b) of the tooth strongly strikes the worm rotor 1, it is made to shift with the notched portion 20 or the periphery 18 as the fulcrum, so that its tip (a) undergoes more displacement and becomes more spaced from the worm rotor 1 resulting in a leakage there and loss of efficiency while the opposite point (c) more severely strikes and rubs the worm rotor thus causing more loss of power.

SUMMARY OF THE INVENTION

It is an object of the invention to provide a rotary machine such as compressor, expander, evacuator or the like of the globoid worm type which eliminates the disadvantages mentioned above and has improved sealing at the surface of contact between the groove of the globoid worm rotor and the tip of the tooth of the pinion.

The rotary machine in accordance with the invention comprises a casing, a globoid worm rotor housed in said casing, and pinions extending through apertures in said casing so as to have their teeth extending into the casing and meshing with said globoid worm rotor, the teeth of said pinion being supported by a support member with an interposed elastic member for resilient displacement in the circumferential and diametric directions, whereby the teeth of the pinion can adaptedly engage the thread of said globoid worm rotor.

The above-mentioned globoid worm type rotary machine in accordance with the invention further comprises a groove formed in said aperture portion contacted by the flat surface of said pinion teeth on the side of the compression chamber formed by the internal surface of the casing, the globoid worm rotor and the pinion, a sealing member inserted in said groove, and means for forcing said sealing member against the flat surface of the pinion teeth.

The above-mentioned rotary machine in accordance with the invention has a groove formed in said aperture portion contacted by the flat surface of said pinion teeth on the side of the compression chamber formed by the internal surface of said casing, said globoid worm rotor and said pinion, and means for introducing pressure oil in said groove.

DETAILED DESCRIPTION OF THE PREFERRED EMBODIMENTS

Figure 5:
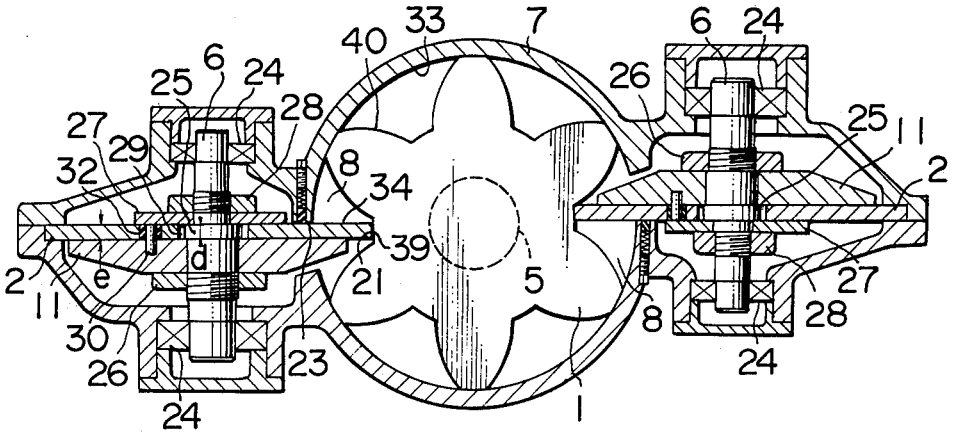
FIG. 5 is a longitudinal cross-section of an embodiment of the present invention.
Figure 6:
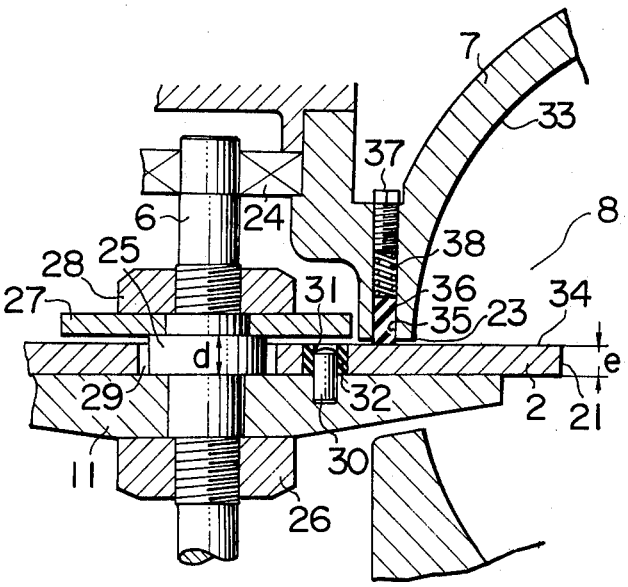
FIG. 6 is an enlarged longitudinal cross-section of port of that which is shown in FIG. 5.

Referring to FIGS. 5 and 6, a globoid worm rotor 1 is housed in a casing 7. A pair of pinions 2 have toothed end portions 21 extending into the casing 7 through apertures 23 in the casing 7 and meshing with the globoid worm rotor 1.

The shaft 6 of the pinion is supported from the casing 7 by bearings 24 at both ends and has a flange 25 about its central port. On the shaft 6 is a support 11 fastened by a nut 26 on one side of the flange 25, and also on the shaft 6 is a washer 27 fastened by a nut 28 on the other side of the flange 25.

The pinion 2, which is placed between the washer 27 and support 11, is provided in its center with a hole 29 of a diameter greater than the diameter of flange 25 and has a thickness "*e*" smaller than the thickness "*d*" of the flange 25 so that the pinion teeth can shift in the circumferential direction and the diametric direction.

The support 11 has a plurality of pins 30, for example, three pins, secured on the side facing the pinion 2, while pinion 2 is provided with holes 31 each containing a cylindrical resilient member 32 into which the end of the pin fits.

The flat face 34 of the pinion on the side of the compression chamber 8 defined by the inner surface 33 of the casing 7, the globoid worm rotor 1 and the pinion 2 is contacted by the aperture portion 23 in which there is formed a groove 35 communicating with the outside of the casing 7 and containing a sealing member 36 therein. The sealing member 36 bears against the flat face 34 of the pinion 2 because of a spring 38 interposed between the sealing membe 36 and an adjustable screw 37 threaded into the groove 35 from outside.

It will thus be seen that because the pinion 2 is secured to the support 11 with the resilient member 32 in between, the tooth of the pinion 2 can shift resiliently in both its circumferential direction and diametric direction so that the tip 21 of the tooth can always be in tight contact with the groove 39 of the globoid worm rotor 1 preventing any leakage of gas from between their contacting surfaces, while, on the other hand, the sealing member 36 bearing against the side face of the pinion 2 prevents leakage of gas between the contacting surfaces of the flat face 34 of the pinion 2 and the aperture portions 23 of the casing. Since the pinion 2 is in resiliently tight contact with the globoid worm rotor 1 at the surface of contact, it does not scratch the globoid worm rotor and does not consume excessive power.

Figure 7:
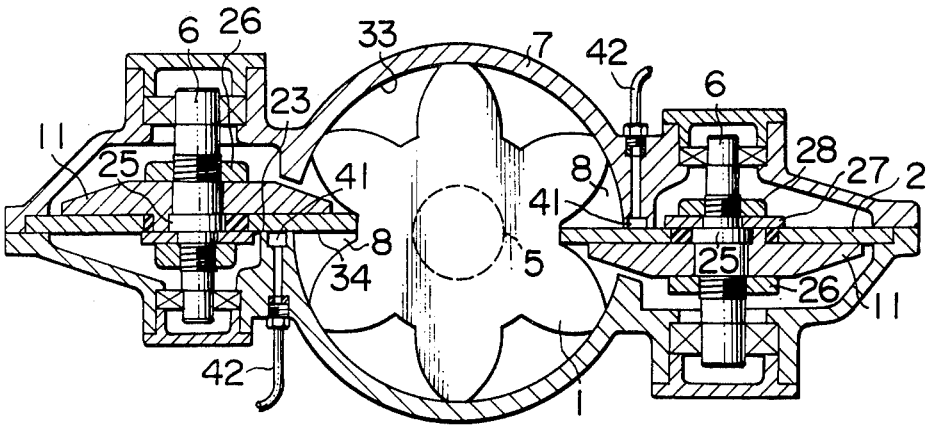
FIG. 7 is a longitudinal cross-section of another embodiment of the invention.
Figure 8:
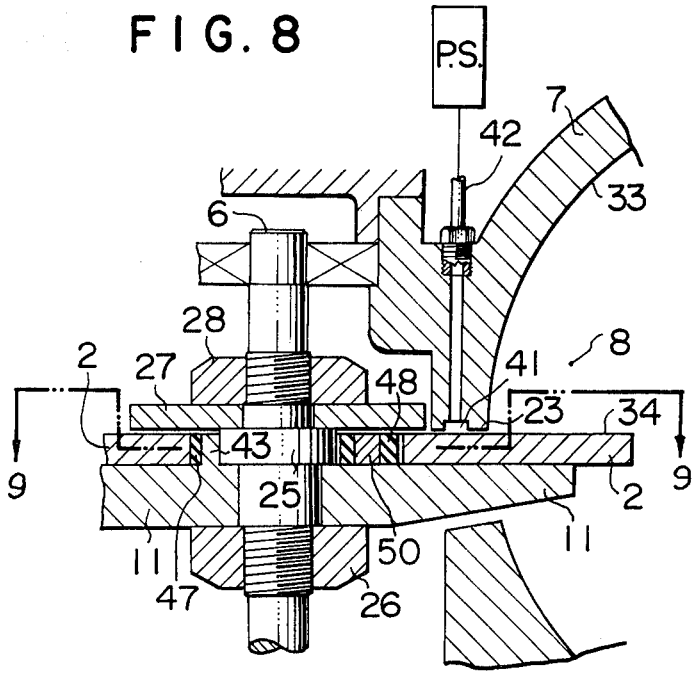
FIG. 8 is an enlarged longitudinal cross-section of that which is shown in FIG. 7.

Referring to FIGS. 7 and 8, a groove 41 is formed in the aperture portion 23 of the casing 7. The groove 41 extends to the outside of the casing 7 and is connected through pipe 42 to a hydraulic pressure source P.S. Gas is prevented from leaking through the gap between the notch portion 23 and the flat face of the pinion 2 because of the pressure and viscosity of the oil fed to the groove 41 from hydraulic source P.S.

Figure 1:
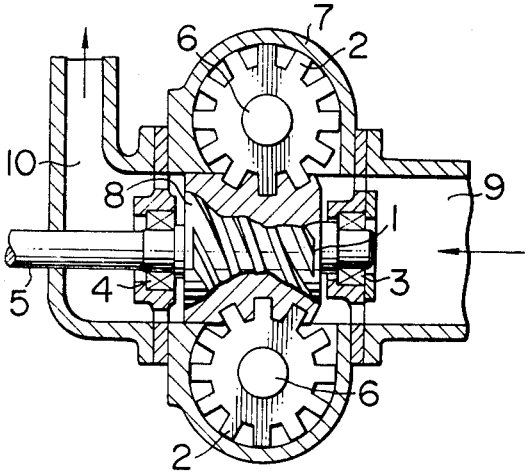
FIG. 1 PRIOR ART
FIG. 1 is a cross-section of a conventional globoid worm type compressor.
Figure 2:
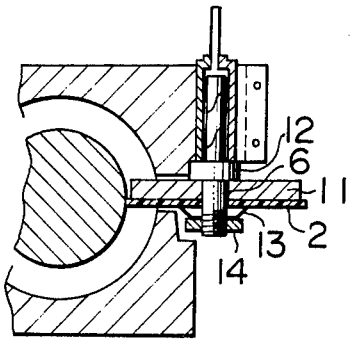
FIG. 2 PRIOR ART
FIG. 2 is a globoid worm type compressor shown in FIG. 7 of French Pat No. 1,331,998.
Figure 3:
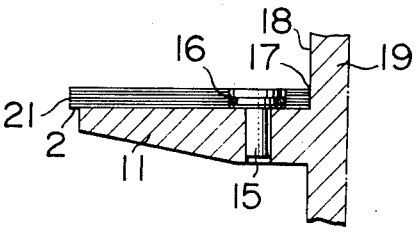
FIG. 3 PRIOR ART
FIG. 3 is FIG. 5 of Japanese Patent Application Forced Publication Sho 48-27303.
Figure 4:
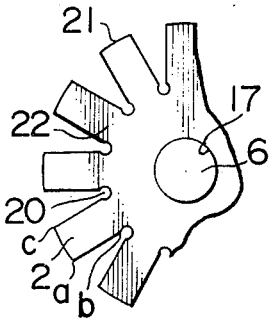
FIG. 4 PRIOR ART
FIG. 4 is FIG. 9 of Japanese Patent Application Forced Publication Sho 48-27303.
Figure 9:
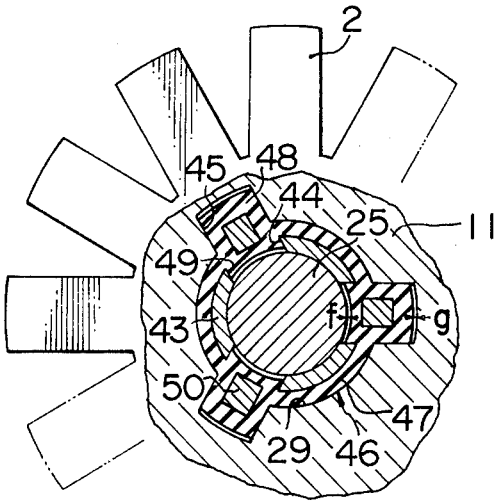
FIG. 9 is a transverse cross-section taken along line A—A in FIG. 8.

Referring to FIGS. 8 and 9, the support 11 has on its side facing the pinion 2 a plurality of projections 43, for example, three projections, engaging the periphery of the flange 25 of shaft 6. The projections 43 are circularly arranged with equal spacings and grooves 44 are formed between the projections 43.

The central hole 29 of pinion 2 has three grooves 45 opposite said grooves 44 and arranged circularly with equal spacings.

A resilient member 46 is inserted in a gap formed between the central hole 29 and grooves 45 of the pinion 2 on the one hand and the projections 43 and grooves 44 of the support 11 on the other hand. Thus, the resilient member 46 comprises circular portions 47 placed in the gaps between the central hole 29 of the pinion 2 and the projections 43 of the support 11, and outwardly extending portions 48 and inwardly extending portions 49 from said circular portions 47, placed in the gaps between the grooves 45 of the pinion 2 and the grooves 44 to the support 11. Small gaps *f* may be provided between the top faces of the inwardly extending portions 49 and the outer surface of the flange 25 in the grooves 44, and also small gaps *g* may be provided between the top faces of the outwardly extending portions 48 and the bottom faces of the grooves 45. Metallic cores 50 may be provided in the projecting portions 48 and 49.

In this embodiment, pinion 2 can resiliently shift in the diametric direction relative to the support 11 owing to the resilient member 46 and can also shift resiliently in the circumferential direction relative to the support 11 owing to the projecting portions 48 and 49 of the resilient member 46.

I claim:

1. A globoid worm type rotary machine comprising a casing, a globoid worm rotor housed in said casing, and pinions extending through apertures in said casing so as to have their teeth extending into the casing and meshing with said globoid worm rotor, a support for said pinion, a rotatable shaft carrying said support, said pinion having a bore receiving said support which bore is larger in diameter than the diameter of the support to permit relative displacement between said pinion and said support in the radial and circumferential directions, and means coupling said pinion to said support and permitting relative displacement between said pinion and said shaft in the circumferential and diametric directions, said means including an elastic member interposed between said support and said pinion for providing resilient displacement of the pinion in its circumferential and diametric directions, whereby said teeth of the pinion can adaptedly engage the threads of said globoid worm rotor.

2. A globoid worm type rotary machine as claimed in claim 1 wherein a groove is formed in said casing proximate said aperture, said pinion having a flat surface facing said aperture on the side of the compression chamber formed by the internal surface of said casing, said globoid worm rotor and said pinion, a sealing member inserted in said groove, and means for forcing said sealing member against the flat surface of the pinion.

3. A globoid worm type rotary machine as claimed in claim 1, wherein a groove is formed in said casing proximate said aperture, said pinion having a flat surface facing said aperture on the side of the compression chamber formed by the inner surface of said casing, said globoid worm rotor and said pinion, and means for introducing pressure oil into said groove.

4. A globoid worm type rotary machine as claimed in claim 1 wherein said means further comprises a plurality of projections on said support, said pinions having holes receiving said projections, said elastic member being interposed between said projections and said pinions.

5. A globoid worm type rotary machine as claimed in claim 4 wherein said projections extend axially and circumferentially.

6. A globoid worm type rotary machine as claimed in claim 5 wherein said holes have radially extending portions.

* * * * *